United States Patent [19]

Megna et al.

[11] 4,254,551

[45] Mar. 10, 1981

[54] SCISSORS-LIKE TOOL

[75] Inventors: Salvatori G. Megna, Sacramento, Calif.; Günther Pracht, Solingen, Fed. Rep. of Germany

[73] Assignee: "Jaguar" Stahlwaren Vertriebsgesellschaft mbH & Co., Solingen, Fed. Rep. of Germany

[21] Appl. No.: 72,720

[22] Filed: Sep. 4, 1979

Related U.S. Application Data

[63] Continuation-in-part of Ser. No. 939,019, Sep. 1, 1978, Pat. No. 4,184,249.

[30] Foreign Application Priority Data

Mar. 16, 1978 [DE] Fed. Rep. of Germany ..... 2811398

[51] Int. Cl.[3] ..... B26B 13/00

[52] U.S. Cl. ..... 30/341

[58] Field of Search ..... 30/341, 254, 260

[56] References Cited

U.S. PATENT DOCUMENTS

| | | | |
|---|---|---|---|
| 242,000 | 5/1881 | Klaucke | 30/341 |
| 2,571,675 | 10/1951 | Bray | 30/341 |
| 2,640,264 | 6/1953 | Sullivan | 30/341 |
| 4,146,961 | 4/1979 | Pinto | 30/341 |
| 4,184,249 | 1/1980 | Megna et al. | 30/41 |

*Primary Examiner*—Jimmy C. Peters

*Attorney, Agent, or Firm*—John C. Smith, Jr.

[57] ABSTRACT

A scissors-like tool, in particular a hairdressers', household or tailors' scissors, comprises a movable scissors blade pivotally connected to a stationary scissors blade with a finger bow disposed on the respective stock portions of the blades. At least the finger bow provided at the movable scissors blade is made per se of synthetic or similar material and is mounted easily rotatable in an outwardly directed edge open recess provided in a finger bow retaining member arranged at the rearward end of the said scissors blade.

5 Claims, 13 Drawing Figures

FIG.1
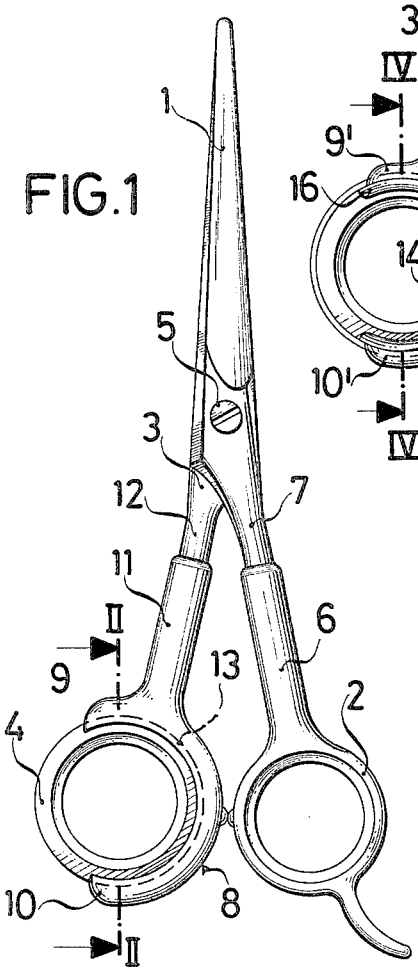
FIG.3
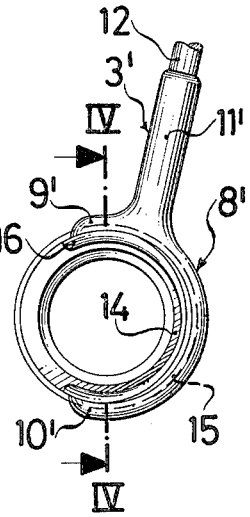
FIG.4
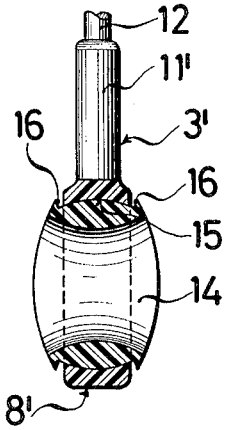
FIG.5
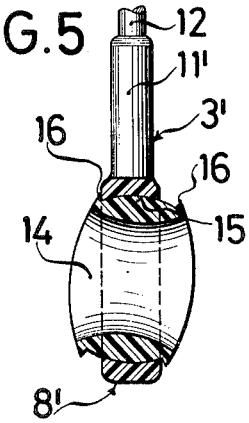
FIG.2
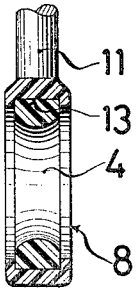
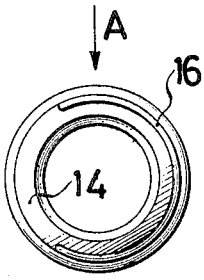
FIG.6
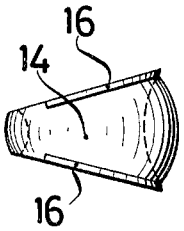
FIG.7

FIG. 8
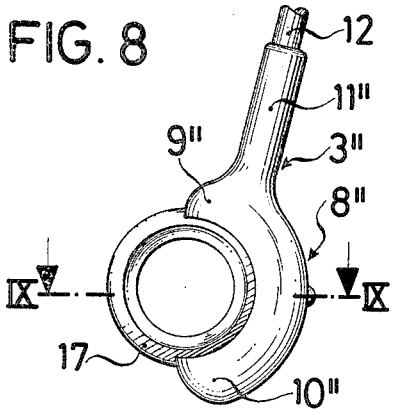
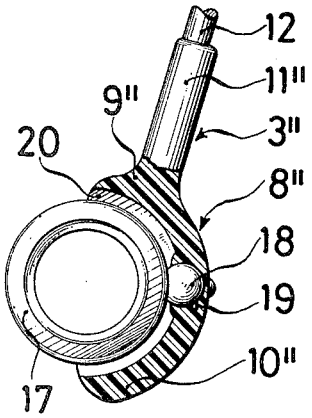
FIG. 10
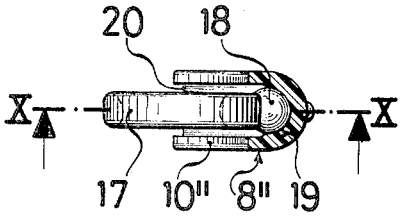
FIG. 9
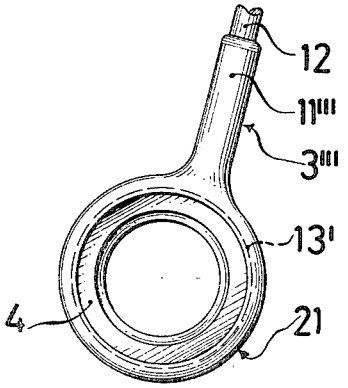
FIG. 11

SCISSORS-LIKE TOOL

OTHER APPLICATIONS

This application is a continuation-in-part of our copending application Ser. No. 939,019 filed Sept. 1, 1978 now U.S. Pat. No. 4,184,249 issued Jan. 22, 1980.

BACKGROUND OF THE INVENTION

This invention relates to a scissors-like tool, in particular a hairdressers', householding or tailors' scissors, which comprises finger bows of which the finger bow specifically provided at the movable scissors blade and made per se of a synthetic or similar material is mounted easily rotatable in an outwardly directed edge open recess provided in a finger bow retaining member arranged at the rearward end of the said scissors blade.

Such scissors are known from U.S. Pat. No. 3,974,563. They have a material disadvantage as do such scissors wherein the bow provided for the thumb is integral with the stock portion of the movable scissors blade, which disadvantage is thus: When opening and closing the scissors, in particular the thumb of the human hand as a result of the relative movement between it and the associated bow of the scissors and the sliding friction occuring is exposed to a thrust stress which has an adverse affect in particular when extensively using the scissors.

SUMMARY OF THE INVENTION

An object of the invention therefore is to arrange the bow of a scissors made per se and provided for receiving in the particular the thumb of one hand, at the movable scissors blade in such a way that the thrust strains on the thumb occurring when opening and closing the scissors are reduced to a minimum.

To attain this object the present invention provides a scissors-like tool, in particular a hairdressers', householding or tailers' scissors, including a movable scissors blade, a stationary scissors blade pivotally connected thereto, and two finger bows arranged at the rearward end of the scissors, at least one of said finger bows being made of synthetic material or the like and mounted in an outwardly open opening at the rearward end of the scissors, said scissors-like tool comprising (a) a movable scissors blade pivotally connected to a stationary scissors blade, each of said blades having a stock portion and a finger bow made per se of synthetic material or the like and fitted through the intermediary of a shank to the respective stock portions of the blades to form handles for the scissors, and (b) a finger bow retaining member having an outwardly directed edge open recess defining an outwardly open opening on at least one of said handles for holding one of the finger bows, the finger bow of said one handle carrying a spherical head at its external circumference, by means of which head it is mounted easily rotatable in a complementary cup defined by the inner side of the outwardly directed recess in the finger bow retaining member. The finger bow as a result of its rotary mounting follows the movements of the thumb upon opening and closing. Thereby, there no longer occurs a relative movement between thumb and bow. The thumb rather engages the inner wall of the bow in an unalterable position, namely only with the work pressure required for opening and closing the scissors. The bow consisting of synthetic or similar material is snapped into the outwardly directed recess of the retaining member. There of course also is the possibility of making the retaining member of resilient material so that a bow made of rigid material is able to be inserted into the recess of the retaining means.

In cases in which the retaining member is flat and due to the presence of the recess therein has the appearance of a fork defining an outwardly directed fork opening, it is advisable to provide the fork with an arcuate groove at its inner surface bordering the recess.

An advantageous embodiment of the invention is one in which the bow externally is formed with a spherical surface and is mounted with this spherical surface easily rotatable and pivotable in a complementary spherical bearing at the inner side of the fork. The bow preferably has projections serving as abutments by means of which it secludes the fork therebetween.

It is thereby achieved that the bow is not only rotatable for reducing the thrust strains on the thumb upon opening and closing the scissors, but also is freely pivotable all about in an angular range limited by the abutments. The pivotability all about is advantageous in the following aspects: The thumb of the one hand with which the scissors is operated, inserted into the bow, when opening and closing a conventional scissors as a result of its inclined position in the bow substantially rests on the one edge of the inner surface of the bow, namely to the major part with its back which is far more pressure-sensitive as compared with the inner surface. The consequence of this are strains which are counteracted up to now, as can for instance be taken from the U.S. Pat. No. 923,734, by a lining of the inner surface of the bow consisting of resilient material. With the scissors according to the invention, on the other hand, the bow as a result of its pivotability all about when pushing through the thumb snugly engages it. Thereby, the thumb does not engage the edge of the bow, and therefore, no strains result when manipulating the scissors. The assembly of the bow may likewise be effected by snapping the bow into the fork opening or into the spherical bearing.

The U.S. Pat. No. 3,906,630 does already disclose scissors wherein the stock of the movable scissors blade is made in two pieces and the bow which is guided with the stock portion provided thereat on the other stock portion is freely pivotable thereabout in a limited angular range. The bow is however not at the same time also rotatable in contradistinction to the scissors-like tool according to the invention.

Regarding the rotatable and at the same time universally pivotable arrangement of the bow, another advantageous embodiment of the invention is one in which the bow has a spherical head at the outer circumference with which head it is mounted in a cup provided at the inner side of the fork and in which the fork has an arcuate groove at the inner surface in which the bow is guided with clearance.

In this embodiment of the invention, the bow is likewise easily rotatable and universally pivotable in a specific angular range. It can likewise be snapped into the fork opening or into the cup as well as into the groove.

It of course is within the scope of the invention to mount the rotatable and the rotatable and universally pivotable bow in a closed bow into which it is likewise snappable.

Another advantageous embodiment of the invention is one in which the spherical head of the bow of the movable scissors blade is secured in a cup by means of a ring consisting of flexible material and the cup is formed integral with a cylindrical shank fixedly mounted on the stock portion of the movable scissors blade.

In this embodiment of the invention the finger bow of the movable scissors blade is, contrary to the embodiments described hereinbefore, pivotable through an unlimited angular range, i.e. by 360°. This is particularly advantageous for a hairdressers' scissors, since it has proved in practice that for performing certain operations an unlimited pivotability of the finger bow is of advantage. Due to its being rotatably secured in position by means of a flexible ring engaging the spherical head of the finger bow with a slight pressure, the finger bow is not freely pivotable. This would be disadvantageous in that for pushing through the thumb, the finger bow possibly first would have to be adjusted to the thumb. For pivoting the finger bow a slight finger pressure must be exerted to it, thereby, after a large pivot movement by means of the thumb, the finger bow automatically moves back into its starting position before the thumb is taken out of the finger bow. Thereby, the finger bow always has a position suitable for easily pushing through the thumb. In this embodiment, furthermore, the fork has been omitted, which fact in particular for a hairdressers' scissors has advantageous effects, since the weight of the scissors is substantially diminished. Furthermore, this finger bow is easily exchangeable.

BRIEF DESCRIPTION OF THE DRAWINGS

Embodiments of the invention will now be described by way of example and with reference to the accompanying drawings, in which:

FIG. 1 is an elevational view of a hairdressers' scissors according to the invention;

FIG. 2 is a sectional view taken along line II—II of FIG. 1;

FIG. 3 is an elevational view of the rearward portion of a movable scissors blade according to a second embodiment of the invention;

FIG. 4 is a sectional view taken along line IV—IV of FIG. 3;

FIG. 5 is the same sectional view as shown in FIG. 4, but with the bow pivoted;

FIG. 6 is an elevational view of the bow;

FIG. 7 is the bow as viewed in direction of the arrow A of FIG. 6;

FIG. 8 is an elevational view of the rearward portion of the movable scissors blade according to a third embodiment;

FIG. 9 is a sectional view taken along line IX—IX of FIG. 8;

FIG. 10 is a sectional view taken along line X-X of FIG. 9;

FIG. 11 is an elevational view of the rearward portion of the movable scissors blade with a closed eye serving to mount the finger bow;

DESCRIPTION OF THE PREFERRED EMBODIMENTS

Figure 12:
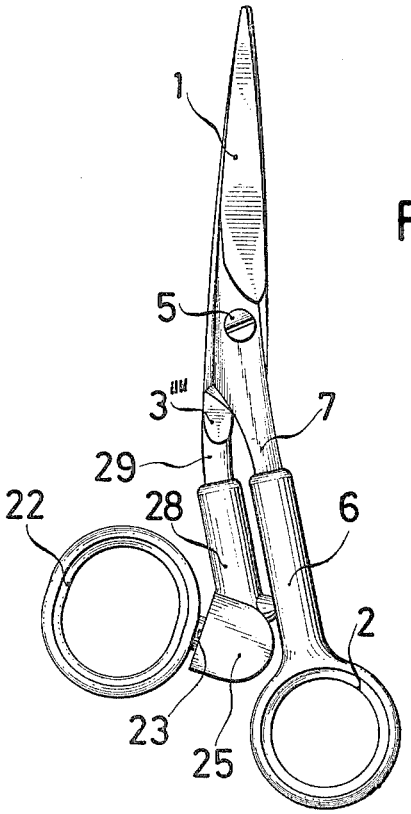
FIG. 12 is a view similar to that shown in FIG. 1 of a hairdressers' scissors according to a fourth embodiment of the invention.

The scissors illustrated in the drawings in FIGS. 1 and 2 comprises a stationary scissors blade 1 with a finger bow 2 and a movable scissors blade 3 with a finger bow 4. The scissors blades 1 and 3 are jointed to one another by a pivot screw 5. The finger bow 2 possesses a hollow-cylindrical shank 6 by means of which it is firmly seated on a stock portion 7 of the stationary scissors blade 1. The finger bow 2 and the hollow-cylindrical shank 6 are made in one piece of synthetic material. The finger bow 4 is made of a resilient synthetic material. The reference numeral 8 designates a finger bow retaining member having an outwardly directed edge open recess so as to resemble a fork defined by fork prongs 9 and 10 with a fork opening open outwardly. The fork 8 has a hollowcylindrical shank 11 at its external circumference by means of which shank it is firmly seated on a stock portion 12 of the movable scissors blade 3. The fork 8 and the shank 11 are made integrally of synthetic material. The fork 8 has an arcuate groove 13 at its inner surface, said groove extending up to the ends of the fork prongs 9 and 10. The finger bow 4 is snapped into the fork opening, i.e. into the groove 13, and freely rotatable therein. The fork prongs 9 and 10 extend over more than half of the peripheral length of the finger bow 4 so that the finger bow 4 is secured in the fork 8.

According to another embodiment of the scissors-like tool of which the movable scissors blade 3' is illustrated partially in FIGS. 3 to 7, the movable finger bow 14 consisting of resilient synthetic material is formed spherical externally. Furthermore, the fork 8' internally has a spherical bearing 15 which extends to the ends of the fork prongs 9' and 10' and in which the finger bow 14 is mounted easily rotatable as well as easily universally pivotable. The movable finger bow 14 as its external circumference has two opposite arcuate projections 16 by means of which it secludes in between the fork 8' with clearance in such a way that the finger bow 14 is only pivotable through a limited angular range. The finger bow 14 is inserted into the fork opening in the same way as the finger bow 4 in the FIG. 1 embodiment in that it is snapped into the fork opening, i.e. into the sperical bearing 15. As in the embodiment according to FIG. 1 a hollow-cylindrical shank 11' is formed integral with the fork 8'.

In the movable scissors blade 3" according to a further embodiment illustrated partially in FIGS. 8 to 10, the finger bow 17 consisting of resilient synthetic material at the external circumference has a spherical head 18 integral with the finger bow 17 by means of which head it is mounted in a cup 19 at the inner surface of the fork 8" slightly rotatable and universally pivotable. The fork 8" at the inner circumference possesses an arcuate groove 20 which extends to the ends of the fork prongs 9" and 10" and into which the finger bow 17 is guided with clearance in such a way that it is movable only in a specific angular range. The finger bow 17 is likewise snapped into the cup 19 and into the groove 20.

The movable scissors blade 3''' illustrated in FIG. 11 in part instead of a fork has a closed eye 21 which internally is provided with a circular groove 13' in which the finger bow 4 is mounted freely rotatable. The finger bow 4 may be snapped into the eye 21 in the same way as into the fork 8.

Figure 13:
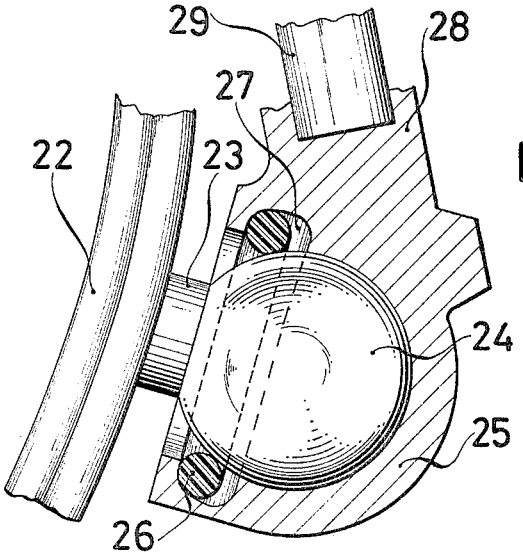
FIG. 13 is a fragmentary longitudinal sectional view, partly in section and on an enlarged scale, of the movable scissors blade of FIG. 12.

In the embodiment shown in FIGS. 12 and 13 the scissorslike tool comprises a movable scissors blade 3'''' having a finger bow 22 and a stock portion 29. The finger bow 22 has at its outer circumference a cylindrical shank 23 at which a spherical head 24 is arranged. The finger bow 22, the cylindrical shank 23 and the spherical head 24 are made in one piece of synthetic material. The finger bow 22 is mounted via the spherical head 24 in a complementary cup 25 and secured in this cup by means of a ring 26 consisting of flexible material and being inserted in an annular groove 27. The cup 25 is formed integral with a cylindrical shank 28 fixedly mounted on the stock portion 29 of the movable scissors blade 3''''. The cup 25 and the cylindrical shank 28 are made integrally of synthetic material.

It is of course within the scope of the invention to arrange the finger bow 2 of the stationary scissors blade 1 likewise rotatable as well as rotatable and universally pivotable.

The invention may be embodied in other specific forms without departing from the spirit or the essential characteristics thereof. The embodiments are therefore to be considered in all respects as illustrative and not restrictive.

What is claimed is:

1. A scissors-like tool, in particular a hairdressers', householding or tailors' scissors, including a movable scissors blade, a stationary scissors blade pivotally connected thereto, and two finger bows arranged at the rearward end of the scissors, at least one of said finger bows being made of synthetic material or the like and mounted in an outwardly open opening at the rearward end of the scissors, said scissors-like tool comprising (a) a movable scissors blade (3'''') pivotally connected to a stationary scissors blade (1), each of said blades having a stock portion (29,7) and a finger bow (22,2) made per se of synthetic material or the like and fitted through the intermediary of a shank (28,6) to the respective stock portions of the blades to form handles for the scissors, and (b) a finger bow retaining member having an outwardly directed edge open recess defining an outwardly open opening on at least one of said handles for holding one of the finger bows, the finger bow of said one handle carrying a spherical head (24) at its external circumference, by means of which head it is mounted easily rotatable in a complementary cup (25) defined by the inner side of the outwardly directed recess in the finger bow retaining member.

2. A tool as set forth in claim 1, wherein the spherical head of the finger bow is secured in the cup by means of a ring (26) made of flexible material.

3. A tool as set forth in claim 1, wherein the finger bow of the movable scissors blade (3'''') is made of resilient synthetic material.

4. A tool as set forth in claim 1, wherein the finger bow retaining member is formed integral with a cylindrical shank (28,6) fixedly mounted on the stock portion (29,7) of the scissors blade.

5. A tool as set forth in claim 1, wherein the spherical head (24) is connected to the finger bow via a shank (23).

* * * * *